US010280628B2

(12) United States Patent
Yin et al.

(10) Patent No.: US 10,280,628 B2
(45) Date of Patent: May 7, 2019

(54) WAFFLE SLAB WITH PLUG

(71) Applicant: RUENTEX ENGINEERING & CONSTRUCTION CO., LTD., Taipei (TW)

(72) Inventors: Samuel Yin, Taipei (TW); Kun-Jung Shu, Taipei (TW)

(73) Assignee: RUENTEX ENGINEERING & CONSTRUCTON, CO., LTD., Taipei (TW)

( * ) Notice: Subject to any disclaimer, the term of this patent is extended or adjusted under 35 U.S.C. 154(b) by 0 days.

(21) Appl. No.: 15/820,483

(22) Filed: Nov. 22, 2017

(65) Prior Publication Data

US 2019/0071881 A1 Mar. 7, 2019

(30) Foreign Application Priority Data

Sep. 6, 2017 (TW) ..... 106213195 U

(51) Int. Cl.
*E04F 15/08* (2006.01)
*E04F 15/024* (2006.01)

(52) U.S. Cl.
CPC ..... *E04F 15/02405* (2013.01); *E04F 15/08* (2013.01)

(58) Field of Classification Search
CPC ..... E04F 15/02405; E04F 15/08; E04F 15/02452; E04B 5/02; E04B 5/026; E04G 21/147; E04G 15/061; F16L 55/11; F16L 55/115
See application file for complete search history.

(56) References Cited

U.S. PATENT DOCUMENTS 4,074,488 A * 2/1978 Ray, III ..... E04F 15/02405 52/126.6
4,261,598 A * 4/1981 Cornwall ..... E03D 11/16 264/31
4,577,448 A * 3/1986 Howorth ..... E01C 5/005 403/408.1
4,619,087 A * 10/1986 Harbeke ..... E04G 15/061 285/64
4,623,170 A * 11/1986 Cornwall ..... E04G 15/061 249/177
5,111,627 A * 5/1992 Brown ..... E04F 15/024 52/126.5
6,088,972 A * 7/2000 Johanneck ..... E04G 15/061 285/4
6,324,793 B1 * 12/2001 Klanke ..... E04H 13/00 27/1
6,357,188 B1 * 3/2002 Lee et al. ..... E02D 29/12 285/124.3

(Continued)

*Primary Examiner* — Brian D Mattei
(74) *Attorney, Agent, or Firm* — Juan Carlos A. Marquez; Marquez IP Law Office, PLLC

(57) ABSTRACT

The subject invention is related to a waffle slab with a plug. The waffle slab comprises a plurality of through holes from the top surface to the bottom surface thereof along its thickness direction, and at least one of the through holes has at least one stop-profile. The plug has at least one profile complementary to the at least one stop-profile of the through holes, so that when the plug is inserted into the at least one through hole, the plug sits on the at least one stop-profile and a top surface of the plug is flush with the top surface of the waffle slab.

17 Claims, 11 Drawing Sheets

(56) References Cited

U.S. PATENT DOCUMENTS

| | | | | |
|---|---|---|---|---|
| 7,581,361 | B1 * | 9/2009 | Murkland | E04B 1/72 220/800 |
| 8,347,906 | B1 * | 1/2013 | Ismert | E03F 5/0407 137/15.01 |
| 9,410,335 | B2 * | 8/2016 | Stubblefield | E04G 23/0203 |
| 9,506,266 | B2 * | 11/2016 | Foldenauer | E04H 12/16 |
| 9,556,566 | B2 * | 1/2017 | Sanders | E01C 5/06 |
| 9,765,541 | B2 * | 9/2017 | Gray | E04G 23/0288 |
| 9,874,036 | B2 * | 1/2018 | Sun | E04H 1/04 |
| 2004/0016190 | A1 * | 1/2004 | Radke | E04G 15/061 52/232 |
| 2015/0167260 | A1 * | 6/2015 | Siqueiros | E01C 5/06 404/73 |
| 2018/0023296 | A1 * | 1/2018 | Recker | E04B 5/02 |

* cited by examiner

WAFFLE SLAB WITH PLUG

FIELD OF THE INVENTION

The present invention relates to the structure of a waffle slab and a plug for being inserted into through holes in the waffle slab.

BACKGROUND OF THE INVENTION

Given the rapid pace of change in the market for high-tech goods, there is a need for fast construction, of high-tech plants in order to meet or exceed the production timeline for fabrication of high-tech products such as chips. To expedite manufacturing, precast columns, precast beams and precast waffle slabs are used, so as to save significant time on pouring concrete and binding reinforcement bars at the construction site. Precast waffle slabs are typically used as the flooring of a clean room of a high-tech factory. A clean room designed to maintain positive pressure such that air with contaminants is exhausted via the through holes provided in the precast waffle slabs. The contaminated air is then filtered and returned into the clean room. However, the through holes in the precast waffle slabs are large enough to potentially hinder placement of machines thereon, which require a smooth surface. A conventional approach for solving this problem is placing raised flooring on at least a portion of the precast waffle slab on which the machines are then placed. However, this approach adds cost and time to arrange the clean room. Another conventional approach is to provide slabs without through holes therein and then milling a predetermined quantity of through holes at predetermined areas of the slabs on which the machines are not to be placed. However, such approach will create dust during the milling process, to which workers will be exposed. Moreover, after the completion of the clean room construction, the dust come from the above-mentioned swilling process needs to be removed, which requires additional labor.

In light of the above, it is desirable to find a solution that uses existing precast waffle slabs and also can fully support machines without the defects in the above conventional approaches.

SUMMARY OF THE INVENTION

In one aspect of the subject invention, a waffle slab is provided that comprises: a plurality of through holes extending from a top surface to a bottom surface of the waffle slab generally along the thickness direction of the waffle slab, and at least one of the through holes has at least one stop-profile.

In another aspect of the subject invention, a waffle slab structure is provided that comprises: the above-mentioned waffle slab; and at least one plug, wherein the least one plug comprises at least one profile complementary to the at least one stop-profile of the at least one of the through holes of the waffle slab, so that when the at least one plug is inserted from the upper side of the waffle slab into the at least one of the through holes along an axial direction thereof, the at least one plug sits on the at least one stop-profile and a top surface of the at least one plug is flush with the top surface of the waffle slab.

In a further aspect of the subject invention, another waffle slab is provided that comprises: a plurality of through holes extending from a top surface to a bottom surface of the waffle slab generally along the thickness direction of the waffle slab, wherein at least one of the plurality of through holes is bound with a hollow tube made of a different material, and the hollow tube has at least one stop-profile.

In a still further aspect of the subject invention, a waffle slab structure is provided that comprises: the above-mentioned another waffle slab; and at least one plug, wherein the least one plug comprises at least one profile complementary to the at least one stop-profile of the hollow tube so that when the at least one plug is inserted from the upper side of the another waffle slab into the at least one of the through holes along an axial direction thereof, the at least one plug sits on the at least one stop-profile of the hollow tube and a top surface of the at least one plug is flush with the top surface of the another waffle slab.

DETAILED DESCRIPTION

Figure 1A:
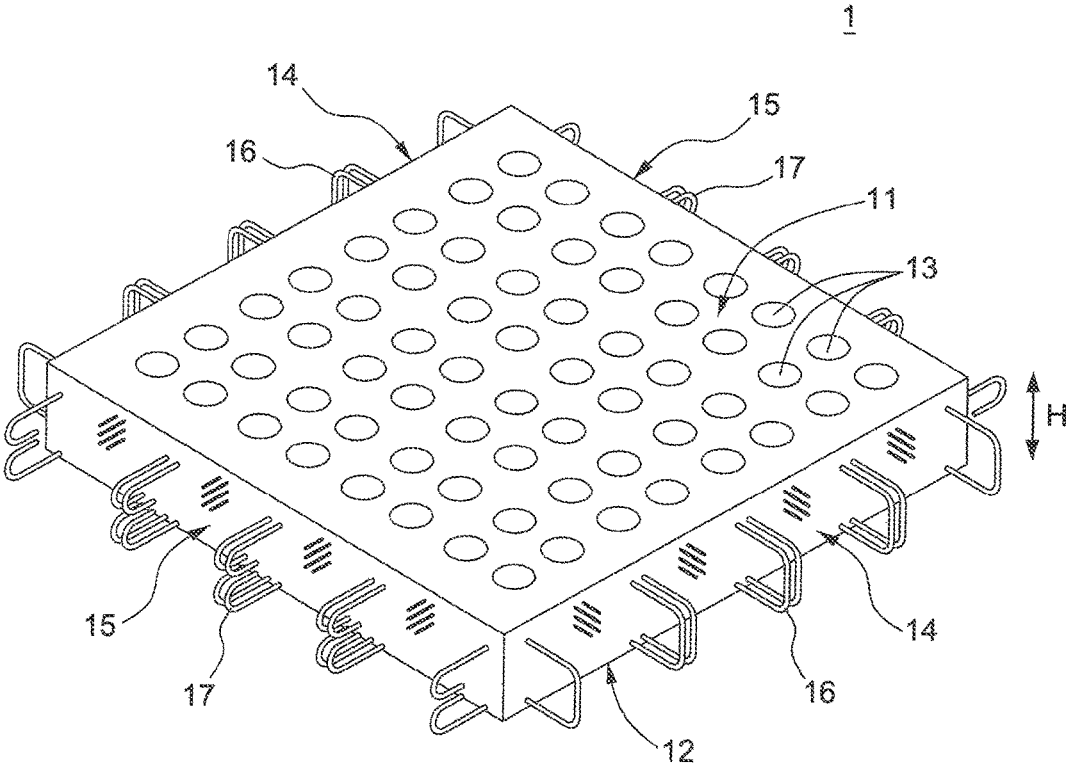
FIG. 1A illustrates a precast waffle slab having a plurality of through holes according to a preferred embodiment of the subject invention.

In order to facilitate understanding of the technical features, technical contents, technical advantages and technical effects of the subject invention, a detailed description with accompanying drawings is provided below for explanation only. Furthermore, the drawings only serve an auxiliary purpose for understanding of the technical contents; the scope of the subject invention should not be interpreted merely based on the scale or the relative positions between the elements illustrated in the drawings.

FIG. 1 illustrates a precast waffle slab having a plurality of through holes therein according to one embodiment of the subject invention. The precast waffle slab 1 is typically used as flooring such as in a wafer foundry ("fab") or a factory for making LCD panels. The waffle slab 1 is generally the shape of a cube, and is made of ferroconcrete. In an alternative embodiment, the waffle slab 1 is not in a cube, but a shape that varies in accordance with the requirements of the plant to be constructed. In FIG. 1A, the precast waffle slab 1 has a top surface 11, a bottom surface 12 and a plurality of through holes 13 extending from the top surface 11 to the bottom surface 12 of the precast waffle slab 1 generally along the thickness direction H of the same. The plurality of the through holes 13 are uniformly distributed in the precast waffle slab 1, and the through holes 13 have a unified dimension and shape so that only a single sized inner mold (not shown) is required for forming the through holes 13 of the precast waffle slab 1. In the instant preferred embodiment, the precast waffle slab 1 have 64 circular through holes 13 in an 8×8 array along the length direction and the width direction thereof. The through holes 13 can be designed to have a dimension (or a diameter) ranging from 35 cm to 39 cm, and the distance between the adjacent through holes ranges from, for example, 60 cm to 65 cm. Of course, in other embodiments, the shape and the dimensions of the through holes 13 are different from those values mentioned above, and can be determined in accordance with the requirements of the building to be constructed. Side rebars 16 extend from each of opposed lateral surfaces 14 and opposed lateral surfaces 15 of the precast waffle slab 1 to be bound with the rebus of a beam structure (not shown) during construction. For example, in the instant preferred embodiment, a plurality of C-shaped side rebars 16 are extended from the lateral surfaces 14 and a plurality of hook-shaped side rebars 17 are extended from the lateral surfaces 15 so that these side rebars 16, 17 can be bound with the rebars of the adjacent beam structures during construction.

Figure 1B:
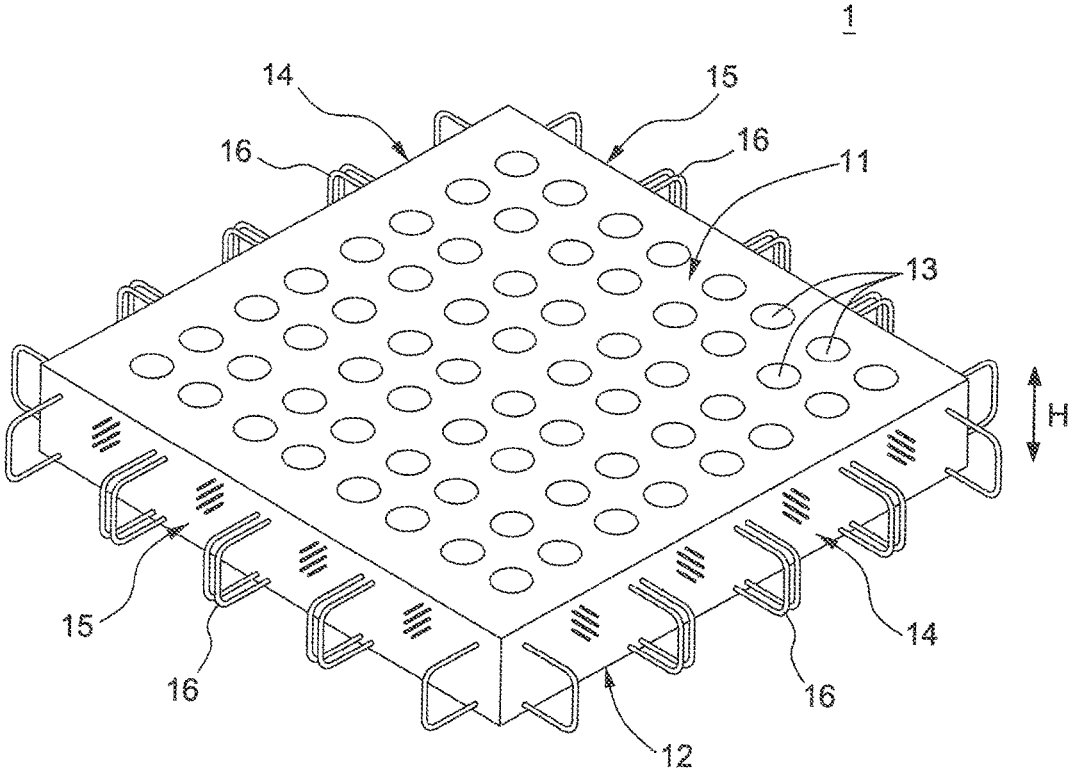
FIG. 1B illustrates a precast waffle slab having a plurality of through holes according to another preferred embodiment of the subject invention.

Alternatively, the side rebars 16 extending from opposed lateral surfaces 14 may have the same shape as that of the side rebars 16 extending from the opposed lateral surface 15 of the precast waffle slab 1. FIG. 1B illustrates another preferred embodiment of the precast waffle slab 1 having a plurality of through holes therein. The structure of the embodiment illustrated in FIG. 1B is basically identical to that illustrated in FIG. 1A. The difference resides in that in FIG. 1B, the C-shaped side rebus 16 extend from both opposed lateral surfaces 14 and opposed lateral surfaces 15 and no hook-shaped side rebars are provided. The side rebars 16 illustrated in FIG. 1B are typically used in a waffle slab 1 used in a panel factory.

The precast waffle slab 1 disclosed in FIG. 1A or FIG. 1B has a sufficient thickness for sustaining its weight so as to serve as a floor, such as that of a fab, a panel factory or the like. The through holes 13 of the waffle slab 1 serve as channels for exhausting dust particles from the clean room. In a building such as a fab, a panel factory or the like, the precast waffle slabs 1 serve as flooring for supporting machines placed thereon and thus need to sustain the heavy weight thereof. Thus, the areas of the floors on which the machines are to be placed require high surface evenness and absence of through holes. In one embodiment of the present invention according to FIGS. 2A-2C, the through holes 13 of the precast waffle plate 1 within an area on which the machines are to be placed are sealed with plugs 2 inserted thereinto. The plugs 2 are configured such that the top surface 21 of the plugs and the top surface 11 of the precast waffle slab 1 form a flat and smooth surface after the plugs 2 are inserted into the corresponding through holes 13 for placing machines. Each of the plugs 2 is a structural body made of, but not limited to, concrete or ferroconcrete.

Figure 2A:
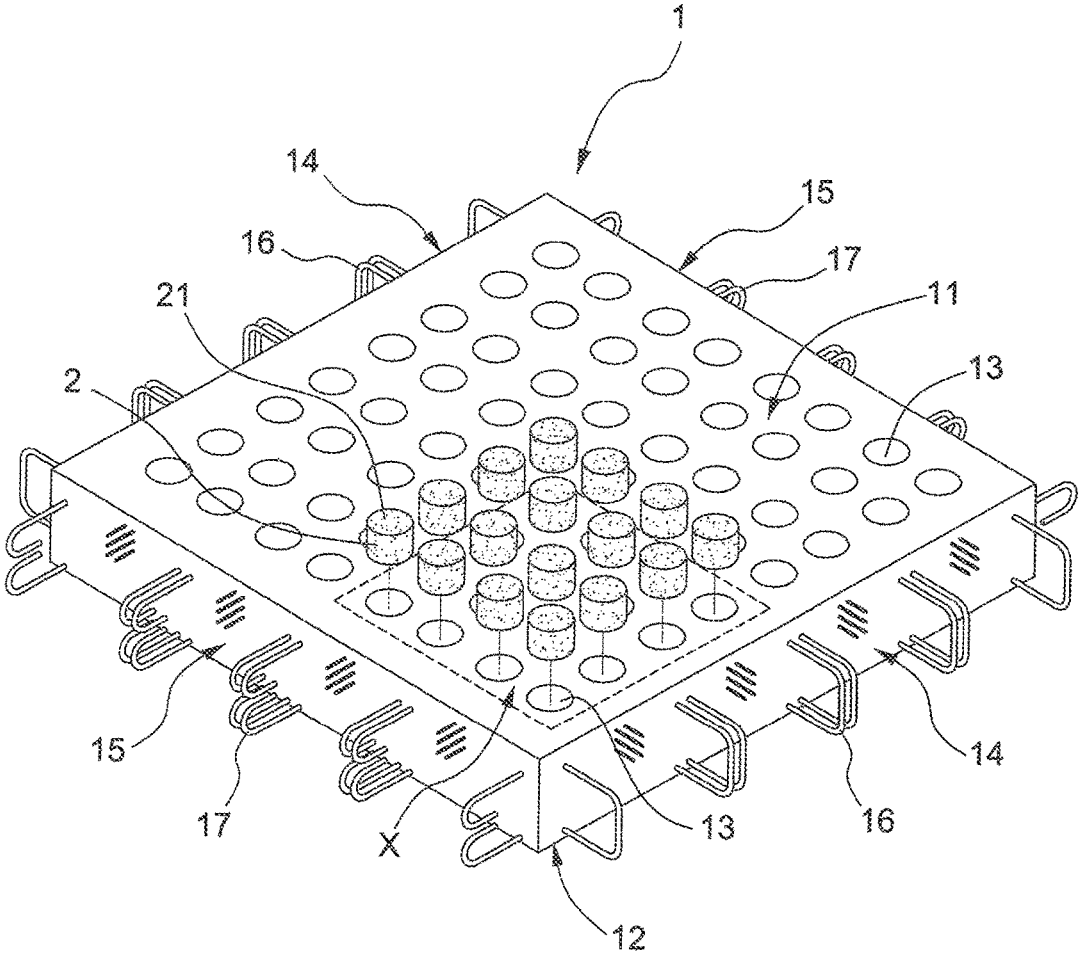
FIGS. 2A to 2C illustrate exemplary figures elucidating the insertion of the plug into the through hole of a precast waffle slab according to a preferred embodiment of the subject invention.
Figure 2B:
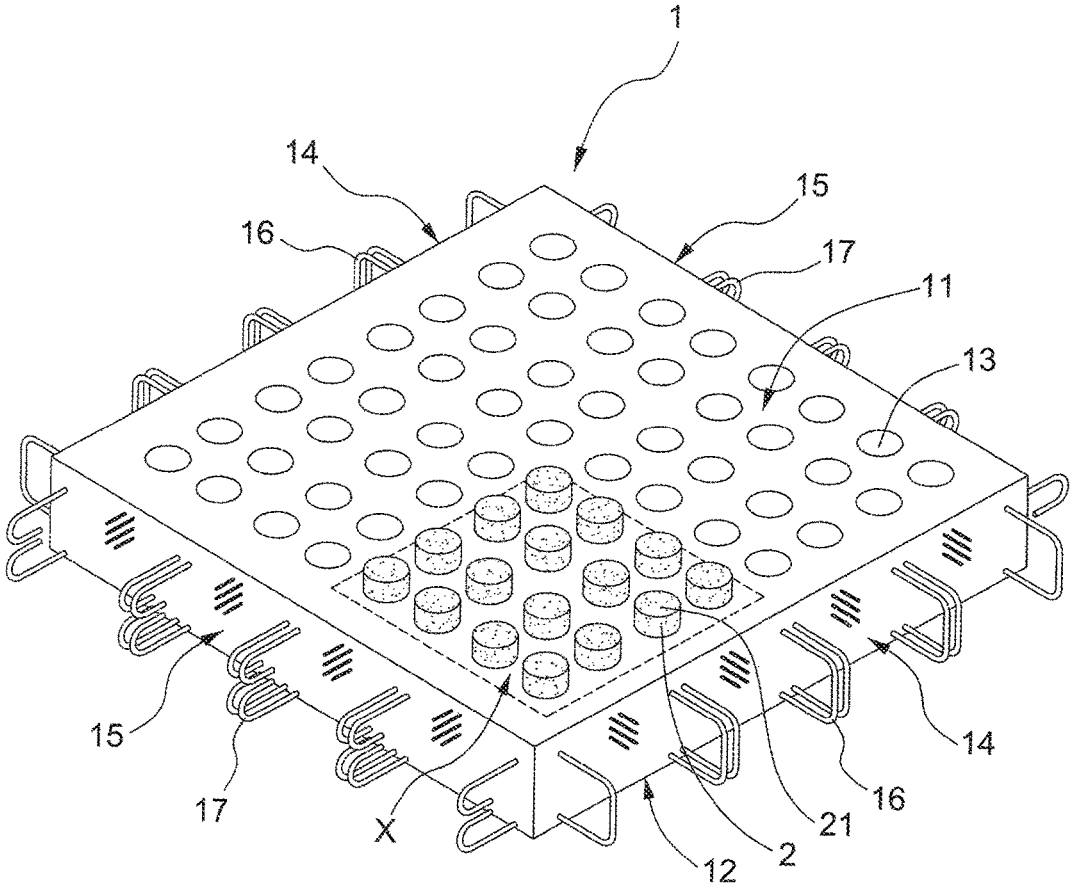
Figure 2C:
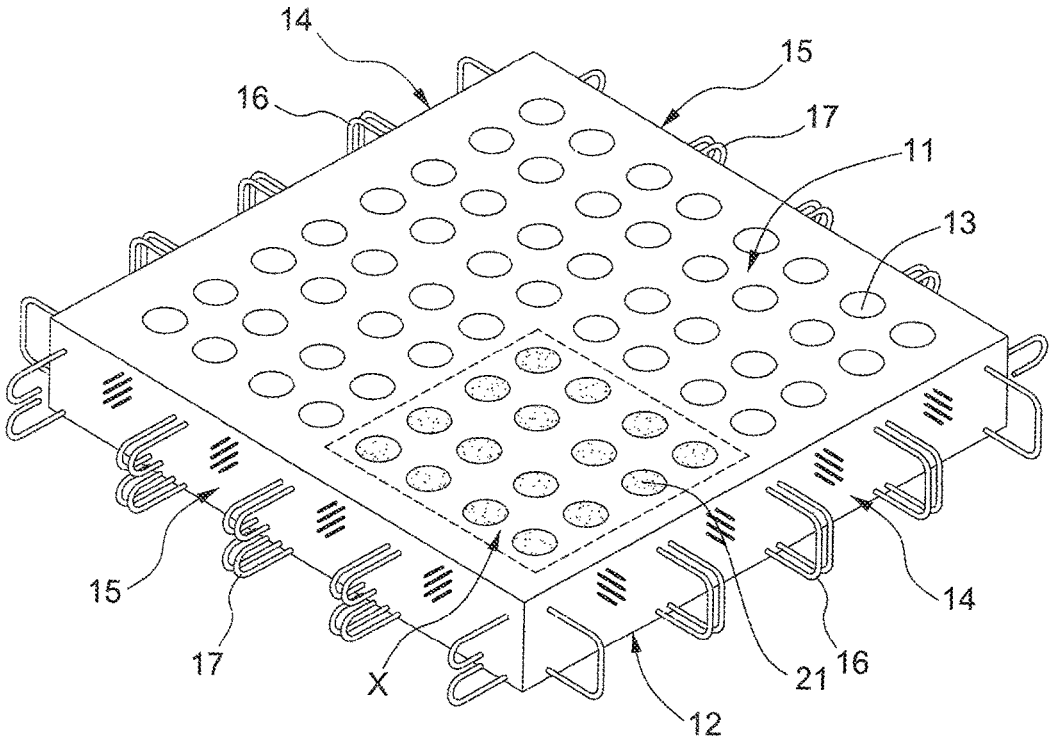

FIGS. 2A to 2C illustrate exemplary figures elucidating the process of the plugs 2 inserted into the through holes 13 of a precast waffle slab 1 according to a preferred embodiment of the subject invention. It should be noticed that although a precast waffle slab 1 having hook-shaped side rebars 17 is presented in FIGS. 2A to 2C, a precast waffle slab 1 having only C-shaped side rebars 16 shown in FIG. 1B is also applicable for use with the plugs 2 shown in FIGS. 2A to 2C as they have the same through holes to mate with the plugs 2.

As illustrated in FIG. 2A, a predetermined area X in the precast waffle slab 1 is to serve as the surface on which the machines are to be placed, and therefore the top surface 11 of the waffle slab 1 within the area X should be filled with plugs 2. In the exemplary embodiment shown in FIG. 2A, the area X has 16 through holes 13 in a 4×4 array. Therefore, it is shown in FIG. 2B that 16 plugs 2 are respectively aligned with aid inserted into the though holes 13. Referring to FIG. 2C, after the insertion of the plugs 2, the top surface 21 of the plugs 2 and the top surface 11 of the precast waffle slab 1 within the area X form a flat surface. In order to render the top surface 21 of the plug 2 flush with the top surface 11 of the precast waffle slab 1, the profile of the top surface 21 of the plug is complementary to the profile of the through hole 13 of the precast waffle slab 1.

Figure 3A:
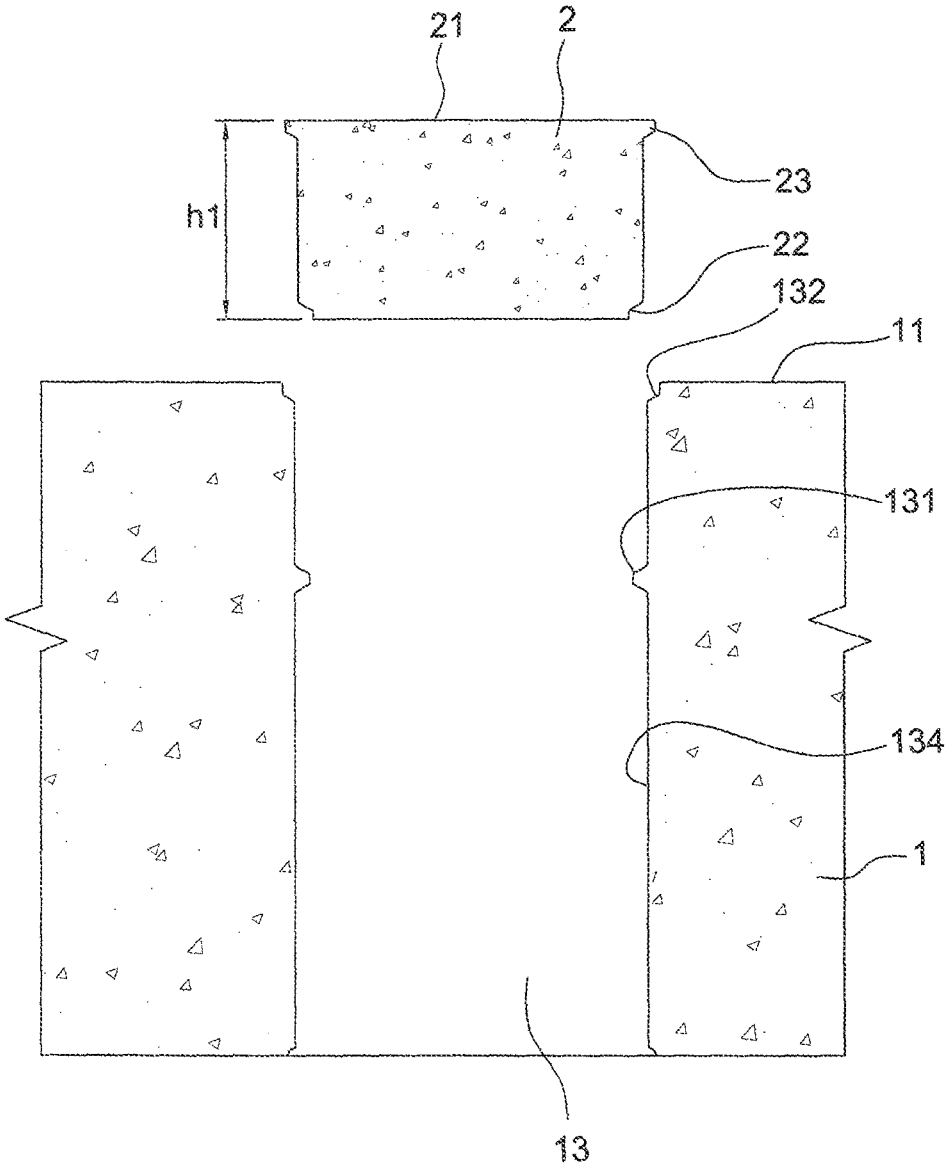
FIGS. 3A to 3C illustrate exemplary cross-section views showing the plug according to a preferred embodiment of the subject invention being inserted into the though hole of the waffle slab.
Figure 3B:
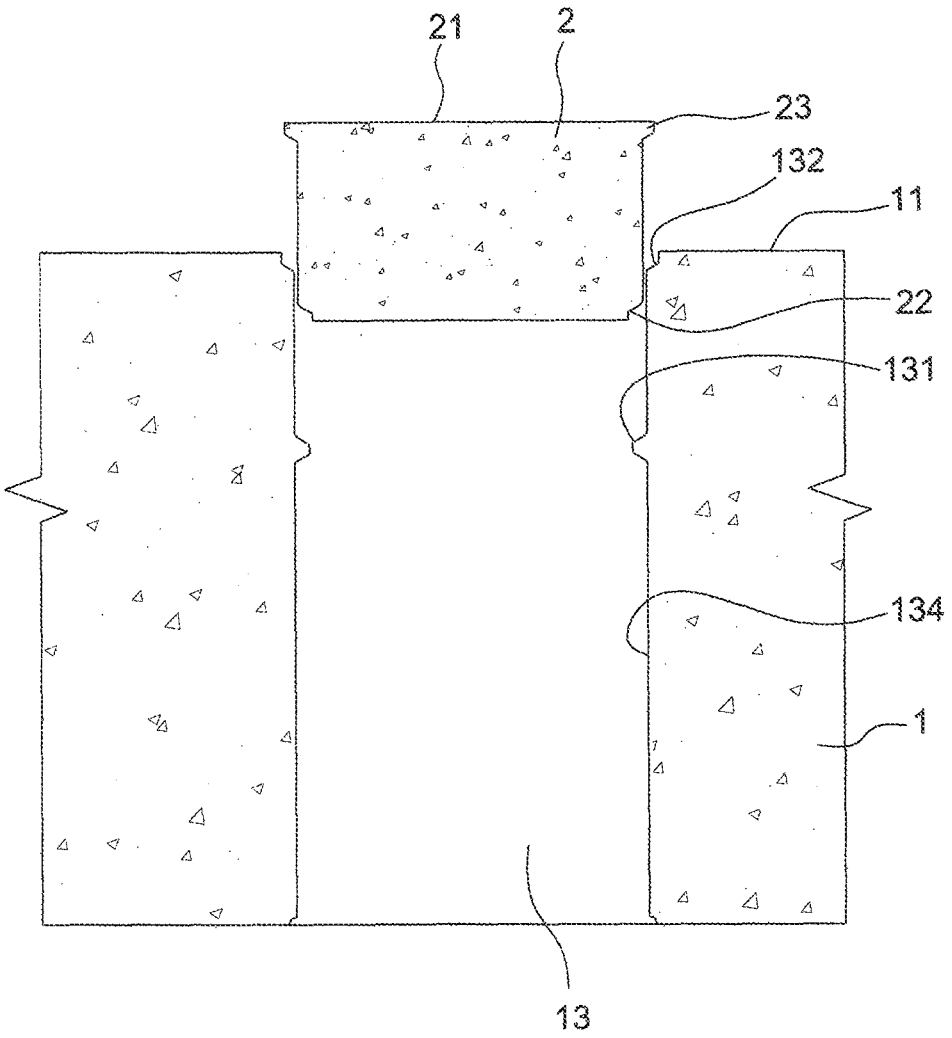
Figure 3C:
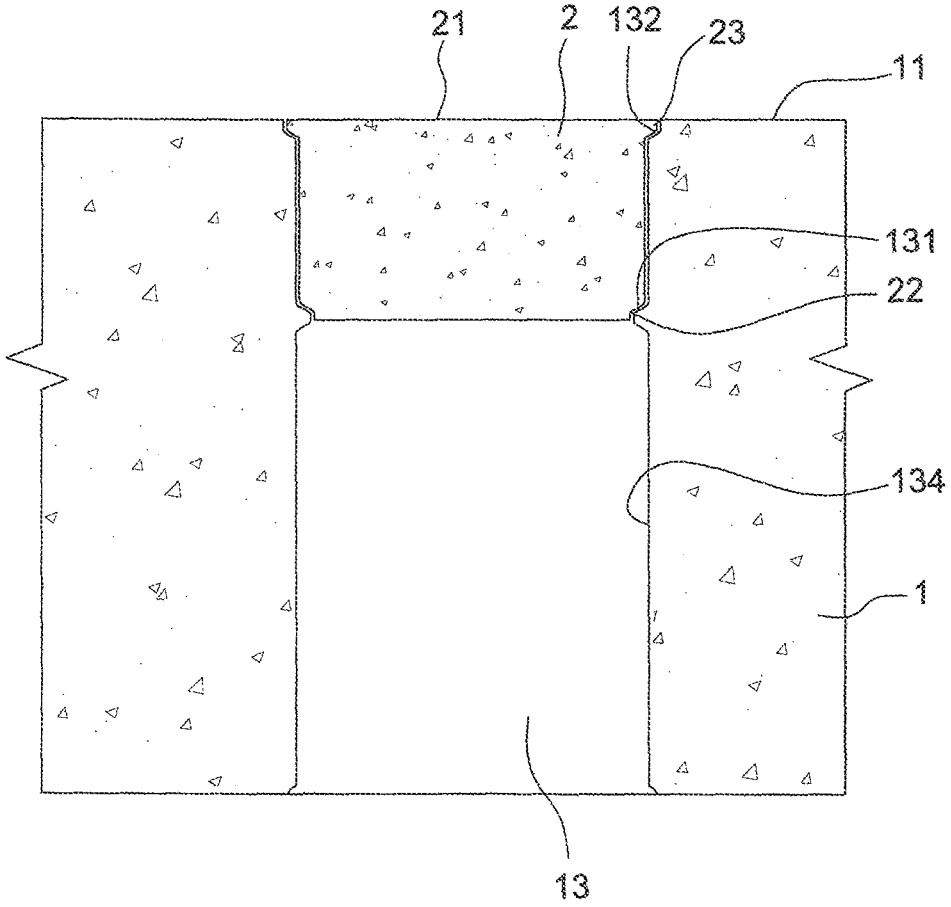

FIGS. 3A to 3C illustrate exemplary cross-section views showing the process of the plugs being inserted into the corresponding though holes of the waffle slab (as illustrated in, but not limited to, the waffle slab of FIGS. 1A and 1B). As illustrated in FIG. 3A, the though hole 13 has at least one stop-profile 131 formed on an inner circumferential surface 134 of the through hole 13. The at least one stop-profile 131 can be at least one protruding portion protruding from the inner circumferential surface 134 in a radial direction toward a center of the at least one through hole 13. In an alternative embodiment, the quantity or the shape of the stop-profile 131 is different from that shown in FIG. 3A. In one embodiment, the at least one stop-profile 131 is two or more of the above-mentioned protruding portions, while in another embodiment, the at least one stop-profile 131 is an annular flange extending along a circumferential direction of the inner circumferential surface 134 of the through hole 13. As shown in FIG. 3A, the lower circumferential edge of the plug 2 has a profile complementary to the stop-profile 131 of the through hole 13. For example, in FIG. 3A the lower circumferential edge of the plug 2 presents a notch 22 complementary to the at least one protruding portion 131 protruding from the inner circumferential surface 134 in a radial direction toward the center of the through hole 13. In other embodiments, the quantity or the shape of the profile 22 is different from that shown in FIG. 3A. In an alternative embodiment, the profile 22 is an annular notch 22 extending along a circumferential direction of the lower circumferential edge of the plug 2.

The height of plug relative to the thickness direction (or height direction) of the precast waffle slab 1 is decided according to actual needs. As can be understood from FIG. 3A, the insertion of the plug 2 into the through hole 13 will be stopped by the stop-profile 131 thereof to prohibit further downward movement of the plug 2 so that the top surface 21 of the plug 2 is flush with the top surface 11 of the precast waffle slab 1. Therefore, the height of the plug 2 is designed based on the position where the stop-profile 131 is disposed on the inner circumferential surface 134 of the through hole 13.

In general, the through hole 13 and the plug 2 are configured such that when the plug 2 is inserted from the upper side of the precast waffle slab 1 into the through hole 13 along an axial direction of the through hole 13, the plug 2 is stopped by the stop-profile 131 and sits on the same. The plug 2 is designed to have a height h1 so that when the plug 2 is inserted into and sits on the stop-profile 131 of the through hole 13, the top surface 21 of the plug 2 is flush with the top surface 11 of the waffle slab 1 (as shown in FIGS. 3B to 3C). Furthermore, as the machines to be placed on the plug 2 are heavy, the plug 2 is preferably to have a specific height (or thickness) for providing sufficient support for the machines. The specific height (or thickness), for example, should be at least one fifth of the depth of the through hole 13 (i.e., h1>⅕H, and is preferably to be in the range of least one fifth to one third of the depth of the through hole 13 (i.e., ⅓H>h1>⅕H) to avoid unnecessary waste of the materials used for fabricating the plug 2.

Moreover, the at least one stop-profile can be alternatively presented in or further comprise at least one recessed profile 132 formed at a corner between the inner circumferential surface 134 of the through hole 13 and the top surface 11 of the waffle slab 1. The recessed profile 132 may be a notch or a chamfer. The quantity or the shape of the recessed profile 132 for stopping the movement of the plug 2 is designed based on actual needs. The recessed profile 132 can be two or more notches or chamfers 132, or an annular notch 132 or an annular chamfer 132 that extends along the circumferential direction of though hole 13 near the top surface 11 of the waffle slab 1. Meanwhile, the upper circumferential edge of the plug 2 has a profile 23 complementary to the recessed profile 132 of the through hole 13. As shown in FIG. 3A, the profile 23 at the upper circumferential edge of the plug 2 is a protruding portion complementary to the recessed profile 132 of the through hole 13. In one embodiment, the profile 23 is two or more of the above-mentioned protruding portions, while in another embodiment, the profile 23 is an annular flange extending along the circumferential direction of the upper circumferential edge of the plug 2.

The through hole 13 and the plug 2 are configured such that when the plug 2 is inserted from the upper side of the precast waffle slab 1 into the through hole 13 along the axial direction thereof, the profile 23 of the plug 2 in the form of the protruding portion is stopped by the recessed profile 132 and sits on the same, and the top surface 21 of the plug 2 is flush with the top surface 11 of the waffle slab 1 (as shown in FIGS. 3B to 3C).

The required stop-profile of the structure of the precast waffle slab 1 as described above can be formed by a steel mold(s) or the like during the precasting process of the waffle slab. After the completion of the precasting process of the waffle slab 1, the steel mold(s) is removed to expose the required stop-profile of the structure. In this way, the mold(s) can be repeatedly used to save the cost for fabricating the precast waffle slab. However, to simplify the precasting process and to speed up the fabrication of the waffle slab 1, hollow tubes made of material different from concrete may be positioned where the through holes 13 are to be formed. In this way, after the completion of the fabrication of the waffle slab 1, the hollow tubes made of a different material are permanently bound with the waffle slab 1, and the through holes 13 are formed with the hollow portions of the hollow tubes. Although in this embodiment, additional hollow tubes made of a different material are required, the fabrication of the precast waffle slab 1 is therefore sped up because the step of removing the mold(s) is omitted. The material of which the hollow tubes are made can be metal, and the metal may be stainless steel, iron or galvanized steel.

Figure 4A:
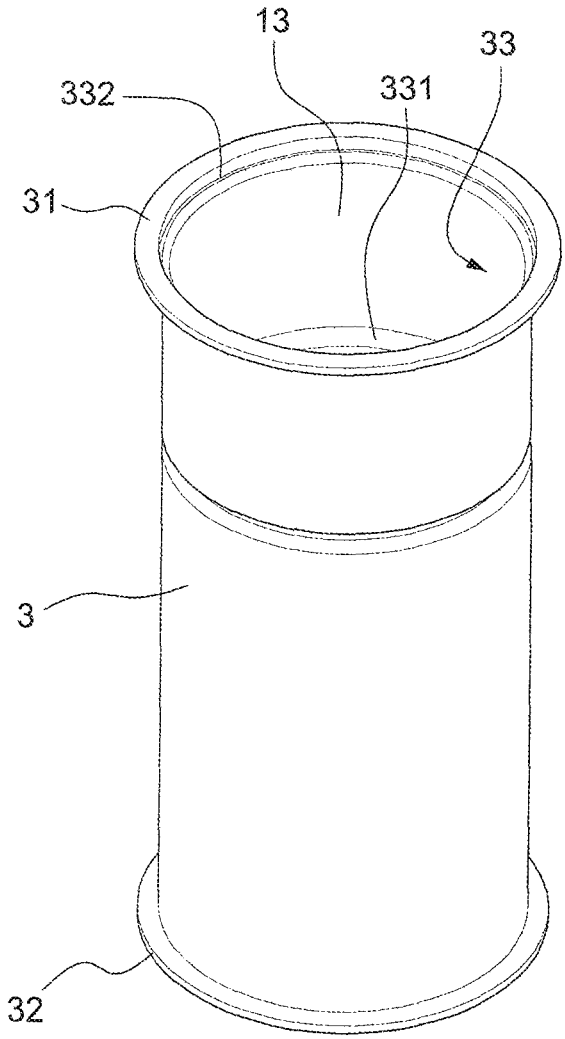
FIG. 4A illustrates the structure of a hollow tube made of a different material according to a preferred embodiment of the subject invention.
Figure 4B:
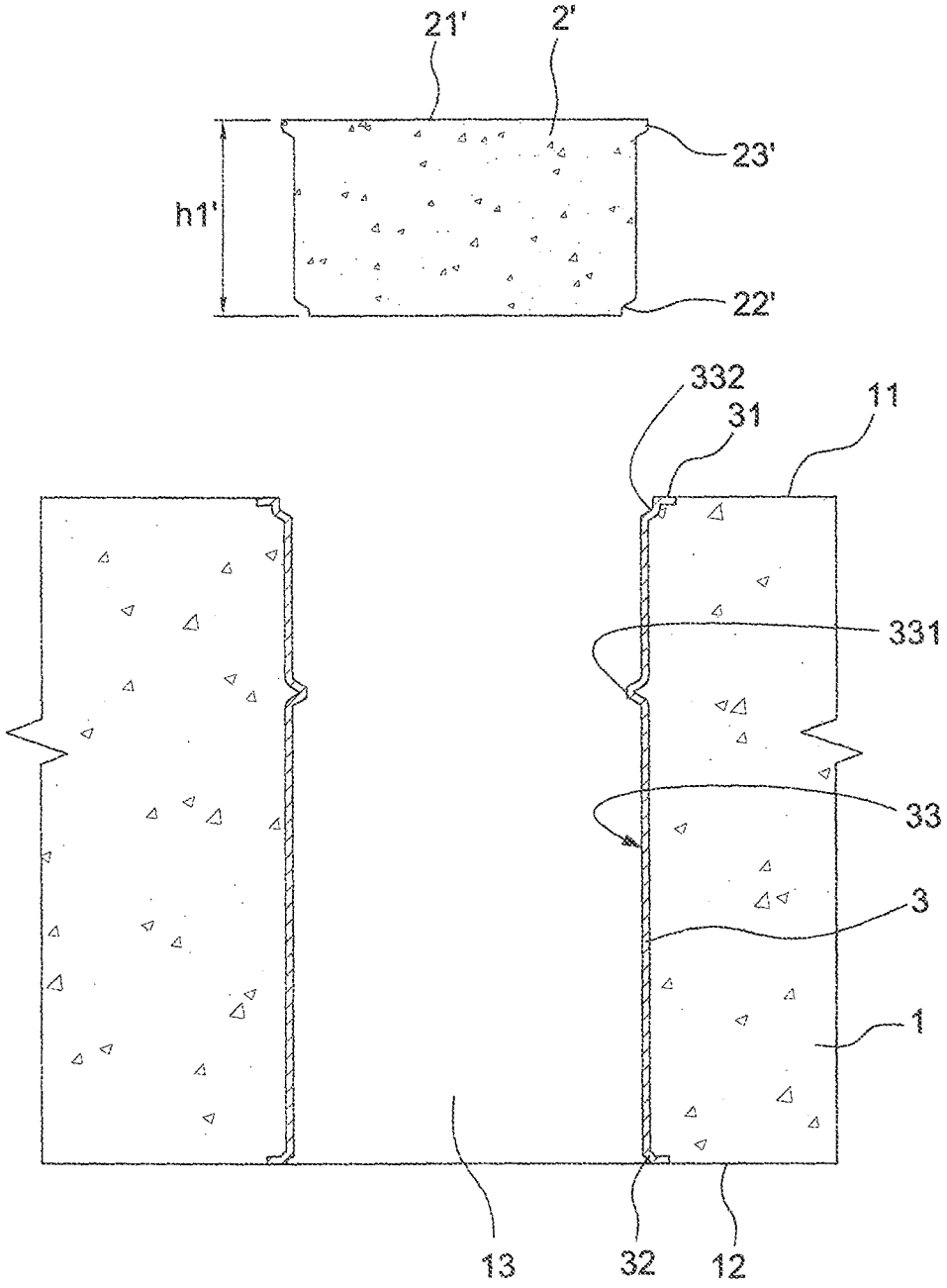
FIGS. 4B and 4C illustrate exemplary figures elucidating the plug being inserted into the through hole formed by the hollow tube made of a different material of the precast waffle slab according to a preferred embodiment of the subject invention.
Figure 4C:
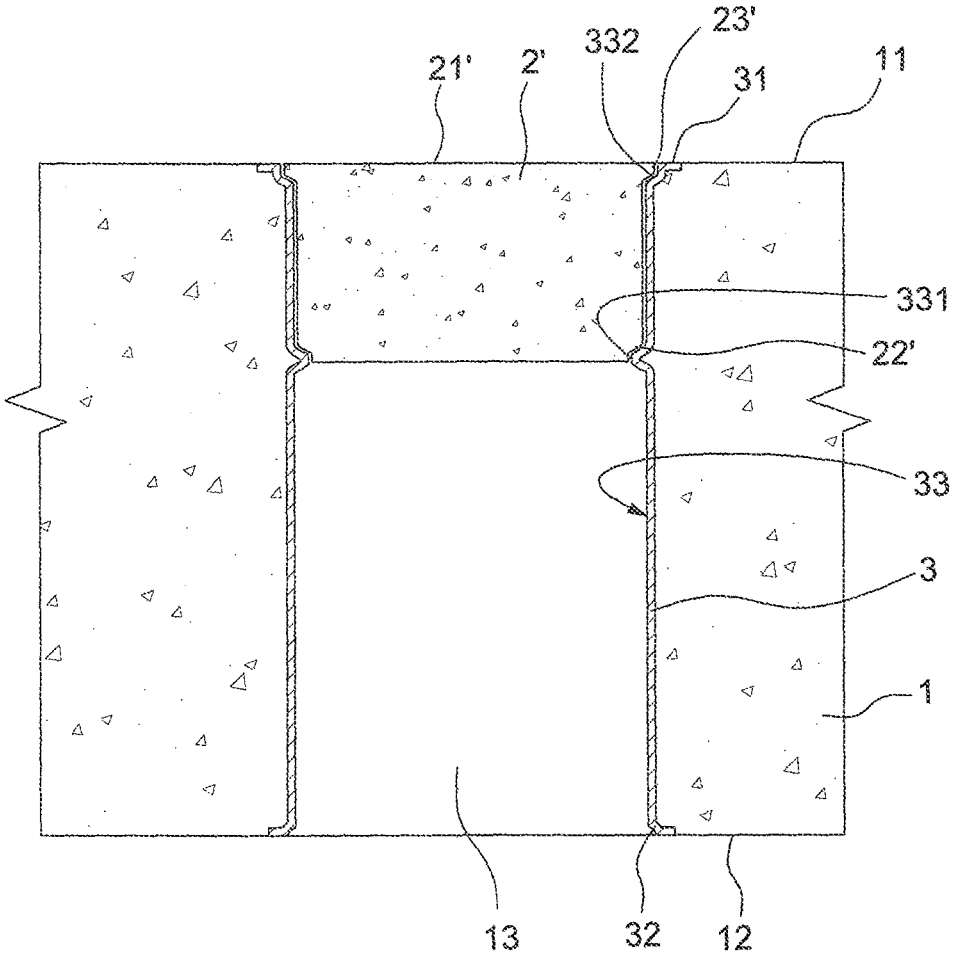

FIG. 4A illustrates the structure of the hollow tube 3 made of a different material according to a preferred embodiment of the subject invention. FIGS. 4B and 4C illustrate exemplary figures elucidating the process of inserting the plugs 2' according to a preferred embodiment of the subject invention into the through holes 13 formed by the hollow tubes 3. As illustrated in FIG. 4A, the height of the hollow tube 3 is preferably equal to the thickness of the precast waffle slab 1. After the formation of the precast waffle slab 1, the hollow tube 3 is permanently bound with the precast waffle slab 1 in the through hole 13, and a top surface 31 and a bottom surface 32 of the hollow tube 3 are respectively flush with the top surface 11 and the bottom surface 12 of the precast waffle slab 1. The hollow portion of the hollow tube 3 forms the through hole 13. In a preferred embodiment of the subject invention, the hollow tube 3 serves as a mold for forming the through hole before the formation of the precast of the waffle slab 1, i.e., before the hollow tube 3 becomes a permanent part of the precast waffle slab 1. That is, the hollow tube 3 serves as an inner mold when concrete is poured into the outer steel molds for forming the waffle slab 1.

In reference to FIG. 2A, in an embodiment where hollow tubes 3 as shown in FIG. 4A are used, a predetermined area of the precast waffle slab 1 embedded with a plurality of hollow tubes 3 serves as the surface on which the machines are to be placed. A required quantity of the plugs 2' are aligned with and inserted into the corresponding through holes 13 formed by the hollow tubes 3. As shown in FIG. 4C, after the insertion of the plugs 2', the top surface 21' of the plugs 2' is flush with the top surface 11 of the precast waffle slab 1 to from a flat surface. Thus, the whole predetermined area becomes a flat surface for the machines to be placed on.

In order form a flat surface from the top surface 21' of the plug 2' and the top surface 11 of the precast waffle slab 1, the profile of the top surface 21' of the plug 2' is complementary to the profile of the through hole 13 formed by the hollow tube 3 of the precast waffle slab 1.

As illustrated in FIG. 4A, the hollow tube 3 made of material different from that of the wafer slab 1 has at least one stop-profile 331 formed on an inner circumferential surface 33 of the hollow tube 3. In one embodiment, the at least one stop-profile 331 is at least one protruding portion protruded from the inner circumferential surface 33 in a radial direction toward a center of the hollow tube 33. The quantity or the shape of the at least one stop-profile 331 is designed based on actual needs. In one embodiment, the at least one stop-profile 331 is two or ore of the above-mentioned protruding portions, while in another embodiment, the at least one stop-profile 331 is an annular flange extending along a circumferential direction of the inner circumferential surface 33 of the hollow tube 3. In one embodiment, the lower circumferential edge of the plug 2' has a profile complementary to the stop-profile 331 of the hollow tube 3. As shown in FIG. 4B, the lower circumferential edge of the plug 2' presents at least one profile 22' which can be a notch complementary to the at least one protruding portion protruding from the inner circumferential surface 33 in a radial direction toward the center of the hollow tube 3. The quantity or the shape of the profile 22' is designed according to actual needs. The profile 22' can be two or more notches, or an annular notch extending along a circumferential direction of the lower circumferential edge of the plug 2'.

The height of plug 2' relative to the thickness direction (or height direction) of the precast waffle slab 1 is decided according to actual needs. Referring to FIGS. 4B and 4C, the inner circumferential surface 33 of the hollow tube 3 is disposed with the at least one stop-profile 331, and the plug 2' is arranged with at least one profile 22' complementary to the at least one stop-profile 331. The insertion of the plug 2' into the through hole 13 will be stopped by the at least one stop-profile 331 to prohibit further downward movement of the plug 2' and the top surface 21' of the plug 2' is then flush with the top surface 11 of the precast waffle slab 1. In light of the above, the height h1' of the plug 2' is decided according to the position where the stop-profile 331 is disposed on the inner circumferential surface 33 of the hollow tube 3.

In other words, the hollow tube 3 and the plug 2' are configured such that when the plug 2' is inserted from the upper side of the precast waffle slab 1 into the through hole 13 of the waffle slab 1 along an axial direction of the through hole 13, the plug 2' is stopped by the at least one stop-profile 331 and sits on the same. The plug 2' has a height h1' so that when the plug 2' is inserted into and sits on the stop-profile 331 of the hollow tube 13, the top surface 21' of the plug 2' is flush with the top surface 11 of the waffle slab 1 (as shown in FIGS. 4B to 4C). Furthermore, given the reason as described for the embodiment shown in FIGS. 3A to 3C that the plug should be able to provide sufficient support for the machines, the plug 2' is preferably to be designed to have a specific height (or thickness) of, for example, at least one fifth of the depth of the through hole 13 (i.e., h1>⅕H), and more preferably within the range of least one fifth to one third of the depth of the through hole 13 (i.e., ⅓H>h1>⅕H) to avoid unnecessary waste of the materials used for fabricating the plug 2'.

Moreover, the at least one stop-profile of the hollow tube 3 can be alternatively in the form of or further comprise at least one recessed profile 332 formed at a corner between the inner circumferential surface 33 of hollow tube 3 and the top surface 31 of the same. The at least one recessed profile 332 can be a notch or a chamfer. The quantity or the shape of the recessed profile 332 for stopping the movement of the plug 2' is designed according to actual needs. The at least one recessed profile 132 can be two or more notches 332, an annular notch or an annular chamfer that extends along the circumferential direction of the hollow tube 3 near the top surface 31 of the same. Meanwhile, the upper circumferential edge of the plug 2' has at least one another profile 23' complementary to the at least one recessed profile 332 of the hollow tube 3 to further restrict the movement of the plug 2'. As shown in FIG. 4B, the profile 23' on the upper circumferential edge of the plug 2' is a protruding portion complementary to the recessed profile 332 of the hollow tube 3. The quantity or the shape of the profile 23' is designed according to actual needs. The profile 23' can be two or more of the above-mentioned protruding portions, or an annular flange extending along the circumferential direction of the upper circumferential edge of the plug 2'.

The hollow tube 3 and the plug 2' are configured such that when the plug 2' is inserted from the upper side of the precast waffle slab 1 into the through hole 13 along the axial direction of the hollow tube 3, the movement of the profile 23' of the plug 2' in the form of the protruding portion is stopped by the recessed profile 332 and sits on the same, and the top surface 21' of the plug 2' is flush with the top surface 11 of the waffle slab 1 (as shown in FIGS. 4B to 4C).

By utilizing the precast waffle slab 1 and the plug 2, 2' provided in the embodiments of the subject invention, raised flooring can be omitted. The precast waffle slabs 1 when inserted with the plugs 2, 2' within a predetermined area(s) provide proper support for placement of the machines in high-tech plants such as a fab, panel factory or the like.

The embodiments as described above only serve the purpose of explaining the technical concept of the subject invention so that a person with general knowledge in the field is able to understand the subject invention and practice it. The above descriptions are not intended to limit the subject invention and any variation or modification based on the spirit of the subject invention should be deemed within the scope of the following claims.

What is claimed is:

1. A precast waffle slab structure, comprising:

a precast waffle slab comprising a plurality of through holes uniformly distributed in and extending from a top surface to a bottom surface of the precast waffle slab generally along the thickness direction of the precast waffle slab and a plurality of side rebars extending from lateral surfaces of the precast waffle slab, wherein each of the through holes has at least one stop-profile, wherein the through holes are for exhausting dust particles from a clean room; and at least one plug comprising at least one profile complementary to the at least one stop-profile of the through holes of the precast waffle slab, so that when the at least one plug is inserted from the upper side of the precast waffle slab into one of the through holes along an axial direction thereof, the at least one plug sits on the at least one stop-profile, and a top surface of the at least one plug and the top surface of the precast waffle slab together form a substantially continuous flat surface, the at least one plug having a height for providing sufficient support for machines placed thereon, the height being at least one fifth of the depth of the plurality of through holes.

2. The precast waffle slab structure according to claim 1, wherein the at least one stop-profile is formed on an inner circumferential surface of each of the through holes.

3. The precast waffle slab structure according to claim 2, wherein the at least one stop-profile is at least one protruding portion protruding from the inner circumferential surface in a radial direction toward the center of each of the through holes.

4. The precast waffle slab structure according to claim 3, wherein the at least one protruding portion is an annular flange extending along a circumferential direction of the inner circumferential surface.

5. The precast waffle slab structure according to claim 4, wherein the at least one stop-profile further comprises at least one notch or at least one chamfer formed at a corner between the inner circumferential surface and the top surface of the precast waffle slab.

6. The precast waffle slab structure according to claim 5, wherein the at least one notch or the at least one chamfer is annular and extends along the circumferential direction of each of the through holes.

7. The precast waffle slab structure according to claim 5, wherein the plug comprises another profile complementary to the at least one notch or the at least one chamfer of the precast waffle slab.

8. A precast waffle slab structure, comprising:

a precast waffle slab comprising a plurality of through holes uniformly distributed in and extending from a top surface to a bottom surface of the precast waffle slab generally along the thickness direction of the precast waffle slab and a plurality of side rebars extending from lateral surfaces of the precast waffle slab, wherein each of the plurality of through holes is formed by a hollow tube made of a different material, and the hollow tube has at least one stop-profile wherein the through holes are for exhausting dust particles from a clean room; and at least one plug comprising at least one profile complementary to the at least one stop-profile of the hollow tube so that when the at least one plug is inserted from the upper side of the precast waffle slab into each of the plurality of through holes along an axial direction thereof, the at least one plug sits on the at least one stop-profile of the hollow tube and a top surface of the at least one plug and the top surface of the precast waffle slab together form a substantially continuous flat surface, the at least one plug having a height for providing sufficient support for machines placed thereon, the height being at least one fifth of the depth of the plurality of through holes.

9. The precast waffle slab structure according to claim 8, wherein the at least one stop-profile is formed on an inner circumferential surface of the hollow tube.

10. The precast waffle slab structure according to claim 9, wherein the at least one stop-profile is at least one protruding portion protruding from the inner circumferential surface of the hollow tube in a radial direction toward the center of the hollow tube.

11. The precast waffle slab structure according to claim 10, wherein the at least one protruding portion is an annular flange extending along a circumferential direction of the inner circumferential surface of the hollow tube.

12. The precast waffle slab structure according to claim 11, wherein a top surface of the hollow tube is flush with the top surface of the precast waffle slab.

13. The precast waffle slab structure according to claim 12, wherein the hollow tube is made of metal.

14. The precast waffle slab structure according to claim 13, wherein the metal is stainless steel, iron or galvanized steel.

15. The precast waffle slab structure according to claim 11, wherein the at least one stop-profile further comprises at least one notch or at least one chamfer formed at a corner between the inner circumferential surface and the top surface of the hollow tube.

16. The precast waffle slab structure according to claim 15, wherein the at least one notch or the at least one chamfer is annular and extends along the circumferential direction of the hollow tube.

17. The precast waffle slab structure according to claim 15, wherein the plug comprises another profile complementary to the at least one notch or the at least one chamfer.

* * * * *